US009316947B2

(12) United States Patent
Munetsugu et al.

(10) Patent No.: US 9,316,947 B2
(45) Date of Patent: Apr. 19, 2016

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Hiroyuki Munetsugu, Yokohama (JP); Tatsuya Suzuki, Kawasaki (JP); Kouki Yano, Kawasaki (JP); Takuya Kitamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/563,857

(22) Filed: Dec. 8, 2014

(65) Prior Publication Data

US 2015/0160585 A1 Jun. 11, 2015

(30) Foreign Application Priority Data

Dec. 10, 2013 (JP) ..... 2013-255203

(51) Int. Cl.
*G03G 15/08* (2006.01)

(52) U.S. Cl.
CPC ..... *G03G 15/0889* (2013.01); *G03G 15/0808* (2013.01)

(58) Field of Classification Search
CPC ..... G03G 15/0893; G03G 15/0883; G03G 15/0877; G03G 15/0891; G03G 15/0865
USPC ..... 399/254
See application file for complete search history.

(56) References Cited

U.S. PATENT DOCUMENTS

| | | | | |
|---|---|---|---|---|
| 4,884,109 | A * | 11/1989 | Hill et al. | 399/261 |
| 2009/0003850 | A1* | 1/2009 | Yamamoto | G03G 15/0808 399/27 |
| 2009/0210931 | A1* | 8/2009 | Hashimoto | G06F 21/35 726/4 |
| 2012/0051799 | A1* | 3/2012 | Kim et al. | 399/281 |
| 2012/0230734 | A1* | 9/2012 | Shimizu et al. | 399/254 |
| 2014/0079415 | A1* | 3/2014 | Fukasawa et al. | 399/27 |

FOREIGN PATENT DOCUMENTS

| | | |
|---|---|---|
| JP | 2008-233419 A | 10/2008 |
| JP | 2010-243913 A | 10/2010 |

OTHER PUBLICATIONS

Machine translation of Kato JP 2008-233419 A, publication date: Oct. 2, 2008.*

* cited by examiner

*Primary Examiner* — Walter L Lindsay, Jr.
*Assistant Examiner* — Frederick Wenderoth
(74) *Attorney, Agent, or Firm* — Canon USA Inc. IP Division

(57) ABSTRACT

An elastically deformable region of an elastic layer in a developer supplying roller is near an agitator. In a state where the agitator agitates a predetermined region or where the agitator is in contact with the developer supplying roller, the agitator is rotated in the same direction as the developer supplying roller.

22 Claims, 10 Drawing Sheets

DEVELOPING DEVICE, PROCESS CARTRIDGE, AND IMAGE FORMING APPARATUS

BACKGROUND OF THE INVENTION

1. Field of the Invention

The present invention relates to a developing device and a process cartridge detachable from an image forming apparatus, such as an electrophotographic copying machine or an electrophotographic printer. In particular, it relates to agitation of developer in a developing device.

2. Description of the Related Art

A known developing device includes at least a developer carrying member configured to carry developer and form a developer image on an image bearing member. The developing device further includes a developer supplying roller configured to supply the developer in contact with the developer carrying member, a regulating member configured to regulate a developer layer on the developer carrying member, a development frame configured to accommodate the developer, and other elements.

The development frame may be provided with a rotatable developer agitator to prevent aggregation or degradation of the developer (for example, Japanese Patent Laid-Open No. 2008-233419 and No. 2010-243913).

However, the developer agitator is spaced away from the developer carrying member and the developer supplying roller, and it is difficult to fully agitate gathered or degraded developer in the vicinity of the developer supplying roller. This may destabilize developer supply and lead to uneven image density (for example, Japanese Patent Laid-Open No. 2008-233419).

SUMMARY OF THE INVENTION

The present invention provides a developing device including developer agitator facilitating circulation of developer near a developer supplying roller.

A developing device according to an aspect of the present invention includes a developer carrying member, a developer supplying roller, and an agitator. The developer carrying member is configured to carry developer. The developer supplying roller is rotatably supported, is in contact with the developer carrying member, and includes a continuous foam elastic layer configured to supply the developer to the developer carrying member. The agitator is rotatable in the same direction as the developer supplying roller and configured to agitate at least part of a predetermined region above the developer supplying roller in a gravity direction. A length of the predetermined region in the gravity direction is a length from an upper portion of the developer supplying roller to a location corresponding to a radius of the developer supplying roller. In a direction of rotation of the developer supplying roller, a region where the elastic layer is elastically deformed from its natural state by coming into contact with the developer carrying member is near the agitator with respect to a line connecting a center of the developer supplying roller and a center of the developer carrying member.

A developing device according to another aspect of the present invention includes a developer carrying member, a developer supplying roller, and an agitator. The developer carrying member is configured to carry developer. The developer supplying roller is rotatably supported, is in contact with the developer carrying member, and includes a continuous foam elastic layer configured to supply the developer to the developer carrying member. The agitator includes a flexible member for agitating the developer, is rotatable in the same direction as the developer supplying roller, and is disposed above the developer supplying roller in a gravity direction. In a direction of rotation of the developer supplying roller, a region where the elastic layer is elastically deformed from its natural state by coming into contact with the developer carrying member is near the agitator with respect to a line connecting a center of the developer supplying roller and a center of the developer carrying member. The flexible member is arranged so as to be caused to come into contact with the developer supplying roller by rotation of the agitator.

The present invention further provides a process cartridge and an image forming apparatus.

Further features of the present invention will become apparent from the following description of exemplary embodiments with reference to the attached drawings.

DESCRIPTION OF THE EMBODIMENTS

Embodiments are illustratively described in detail below with reference to the drawings. The functions, materials, shapes, relative arrangements of components, and the like described in the embodiments are not intended to limit the scope of the invention unless there are particularly specific descriptions. The materials, shapes, and the like of members described apply to those in the subsequent description unless otherwise stated.

First Embodiment

A developing device and a process cartridge according to the present invention are described below with reference to the drawings.

Figure 4A:
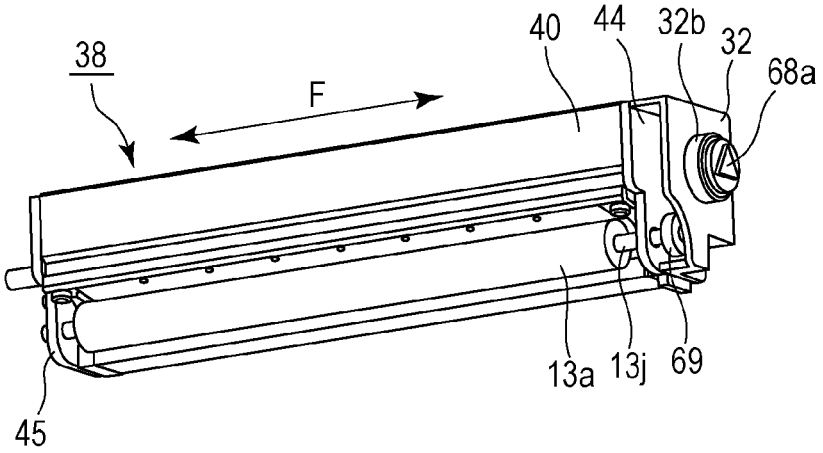
FIG. 4A is an external perspective view of the developing device according to the first embodiment of the present invention.
Figure 4B:
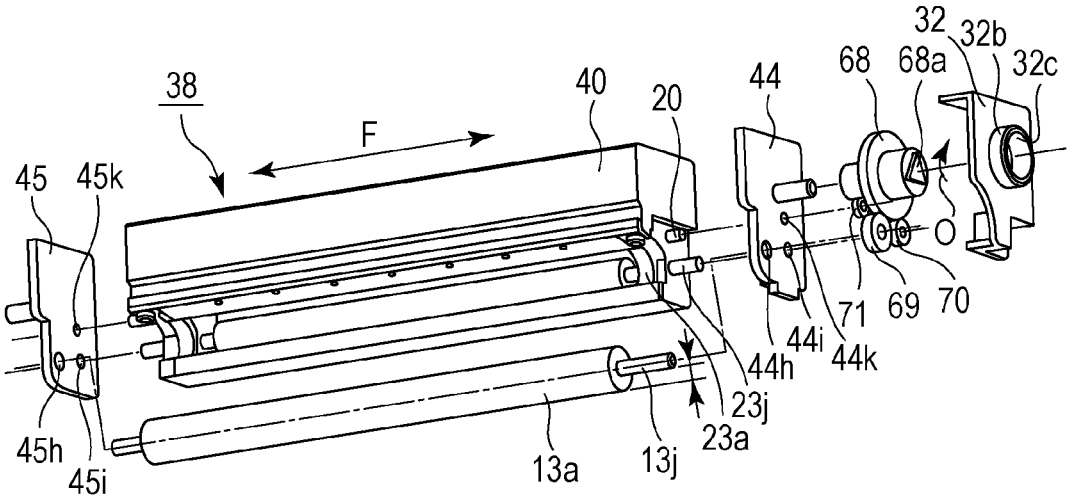
FIG. 4B is an exploded perspective view thereof.

FIGS. 4A and 4B are perspective views of a developing device 38. FIG. 4A is an external perspective view of the developing device 38 in an assembled state. FIG. 4B is an exploded perspective view of the developing device 38.

In the following description, a longitudinal direction F coincides with the direction of a longer side of the developing device 38, as illustrated in FIGS. 4A and 4B. In the longitudinal direction F, a side where drive gears (development roller gear 69, supply roller gear 70, development input gear 68, agitation gear 71) is referred to as a drive side, and another side is referred to as a non-drive side.

Figure 2:
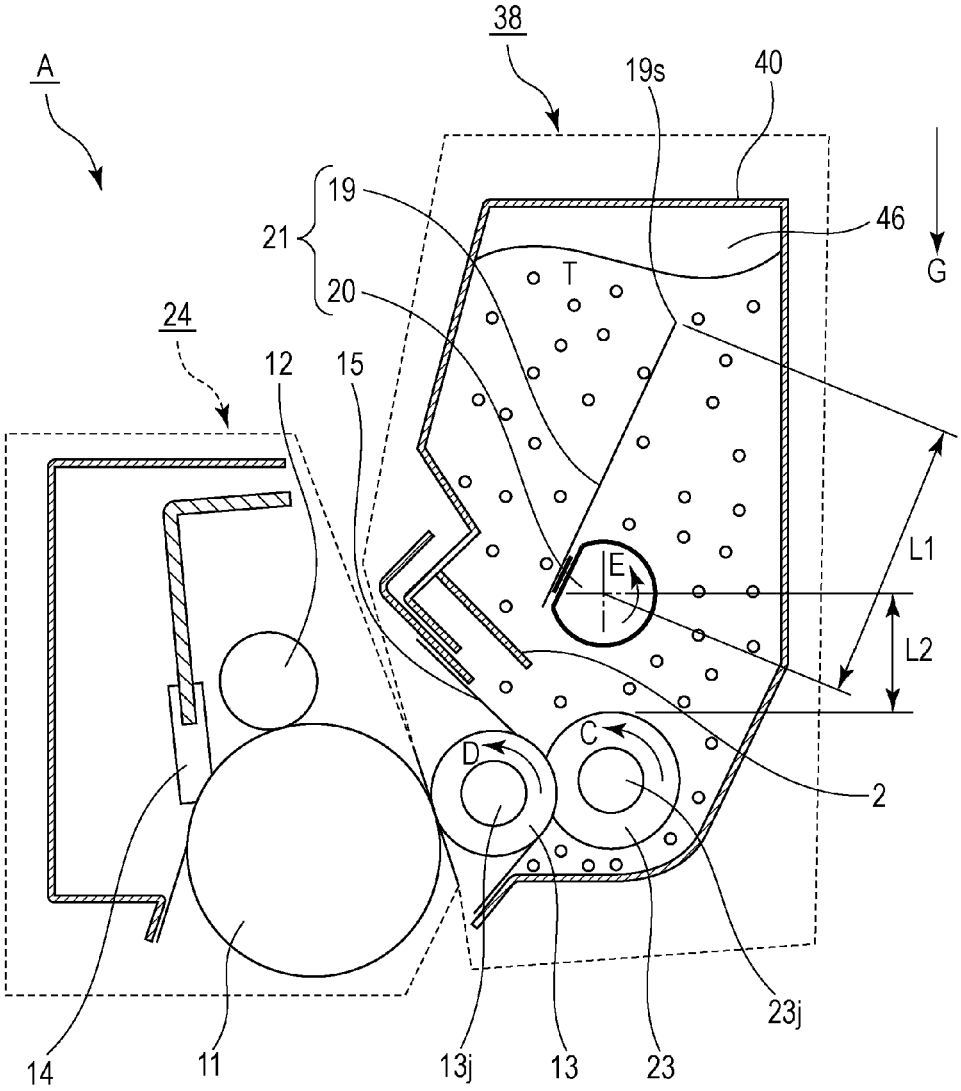
FIG. 2 is a sectional view of a process cartridge according to the first embodiment of the present invention.
Figure 3:
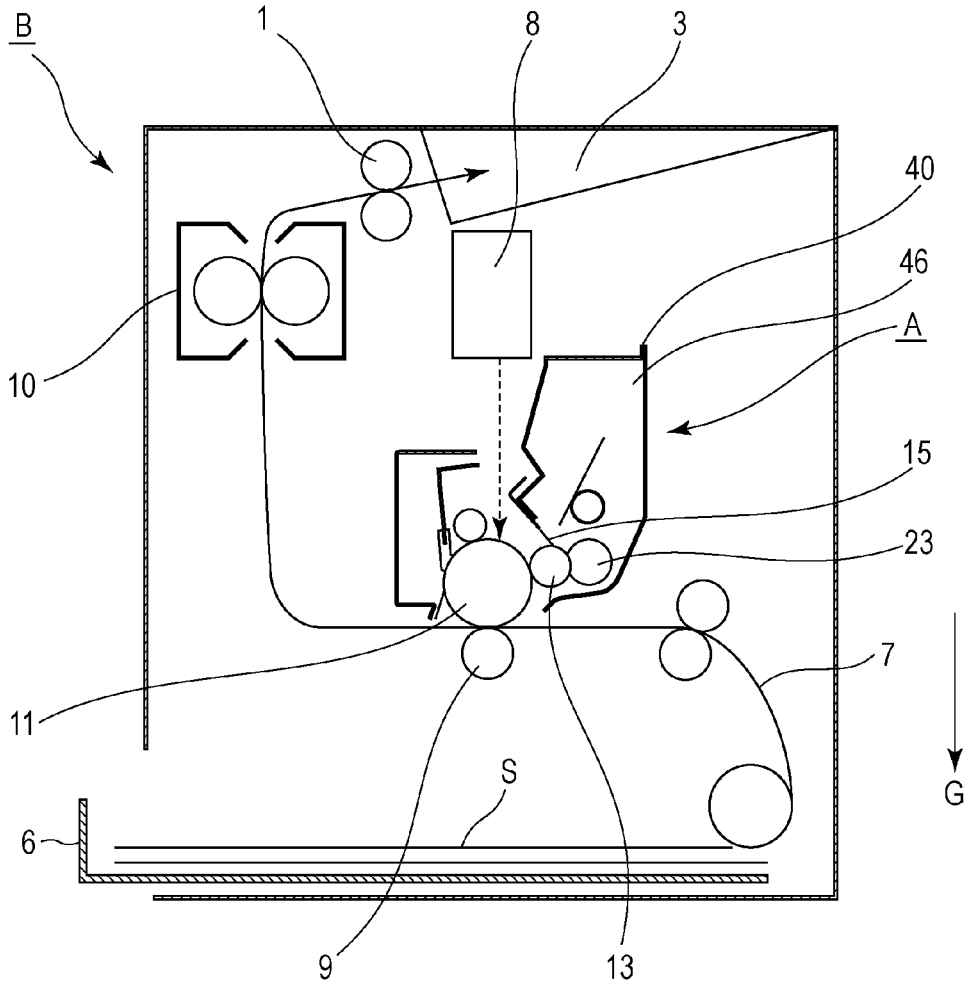
FIG. 3 is a sectional view of an image forming apparatus according to the first embodiment of the present invention.

FIG. 2 is a sectional view of a process cartridge A to which the present invention is applicable. FIG. 3 illustrates a sectional view of an image forming apparatus B to which the present invention is applicable.

[Configuration Outline of Process Cartridge]

The process cartridge A includes a photosensitive drum 11 as an image bearing member and a process means that acts on the photosensitive drum 11. The process means may include, for example, a charger configured to charge a surface of the photosensitive drum 11, the developing device 38 configured to form a developer image on the photosensitive drum 11, and a cleaner configured to remove developer T (including toner, carrier, and the like) remaining on the surface of the photosensitive drum 11.

The process cartridge A according to the present embodiment includes a charging roller 12 being the charger and a cleaner unit 24 including an elastic cleaning blade 14 as the cleaner around the photosensitive drum 11, as illustrated in FIG. 2. The process cartridge A further includes the developing device 38. The cleaner unit 24 and the developing device 38 in the process cartridge A are integral with each other. The process cartridge A is detachably attached to the image forming apparatus B, as illustrated in FIG. 3. The developing device 38 includes a development roller 13 as a developer carrying member being a developing means, a development blade 15, a developer supplying roller 23 (hereinafter referred to as supplying roller) configured to supply the developer T to the development roller 13, and an agitator 21.

[Configuration Outline of Image Forming Apparatus]

The process cartridge A is attached to the image forming apparatus B illustrated in FIG. 3 and is used in forming images. To form an image, a sheet S is conveyed from a sheet cassette 6 attached to a lower portion of the image forming apparatus B by a conveying roller 7, an exposure device 8 performs selective exposure on the photosensitive drum 11 in synchronization with the conveyance of the sheet S, and a latent image is formed. The developer T is supplied to the development roller 13 by the supplying roller 23, and a thin layer is formed on the surface of the development roller 13 by the development blade 15. The developer T is supplied in accordance with the latent image by the application of a development bias to the development roller 13 from the image forming apparatus B, the latent image is developed, and a developer image is formed. The developer image is transferred to the conveyed sheet S by the application of a bias voltage to a transfer roller 9. The sheet S is conveyed to a fixing device 10, the image is fixed, and the sheet S is discharged to a sheet discharge part 3 in an upper portion of the image forming apparatus B by a discharge roller 1.

In the present embodiment, the configuration in which the single process cartridge A is attached to the image forming apparatus B is illustrated. Another configuration in which a plurality of process cartridges A accommodating yellow, magenta, cyan, and black developer corresponding to a full color image are attachable may also be used.

[Configuration Outline of Developing Device]

Next, a configuration of the developing device 38 is described with reference to FIGS. 2, 4A, and 4B. FIG. 2 is a sectional view of the process cartridge A. FIG. 4A is an external perspective view of the developing device 38. FIG. 4B is an exploded perspective view of the developing device 38. The developing device 38 includes the development roller 13, the supplying roller 23, the development blade 15, a development frame 40, a drive side bearing 44, a non-drive side bearing 45, a development cover member 32, the agitator 21, and the like. The development roller 13 includes an elastic layer 13*a* and a metal core 13*j*. The supplying roller 23 includes an elastic layer 23*a* and a metal core 23*j*.

The supply roller 23 has a diameter of 11 mm and a radius of 5.5 mm. The metal core 23*j* has a diameter of 4 mm and a radius of 2 mm. The elastic layer 23*a* in the supplying roller 23 is a foam sponge layer made of a urethane material and has a continuous foam structure in which neighboring cells inside the foam sponge layer are contiguous at a desired ratio. The elastic layer 23*a* has a thickness t of 3.5 mm. The amount of surface air flow as the amount of air passing through the foam sponge layer when the outside of the foam sponge layer and the inside thereof are in equilibrium is 1.5 liters per minute.

In the present embodiment, the distance between the center of the metal core 13*j* in the development roller 13 and the center of the metal core 23*j* in the supplying roller 23 (hereinafter referred to as center-to-center spacing) is 9.5 mm. The development roller 13 is set such that its surface presses the foam sponge layer 23*a* in the supplying roller 23 with an inroad amount of approximately 1.0 mm. The inroad amount here is the length obtained by subtracting the above-described center-to-center spacing from the value in which the sum of the outer diameter of the elastic layer 23*a* in the supplying roller 23 and the outer diameter of the elastic layer 13*a* in the development roller 13 is divided by two on the line segment connecting the center of the metal core 13*j* and the center of the metal core 23*j*.

The agitator 21 includes an agitating shaft member 20 and a sheet member 19 as a flexible member. The sheet member 19 is connected to the agitating shaft member 20 on one end side and has a free end 19*s* on another end side. The distance L1 between the center of the agitating shaft member 20 and the end surface on the free end side of the sheet member 19 is longer than the distance L2 between the center of the agitating shaft member 20 and the surface of the elastic layer 23*a* in the supplying roller 23. The sheet member 19 is made of polyethylene terephthalate (PET) and a thickness of 38 μm. The material and thickness of each of the elastic layer 23*a* in the supplying roller 23 and the sheet member 19 are not limited to the above-described ones, and any material and thickness may be selected. The development frame 40 includes a developer containing chamber 46 containing the developer T to be supplied to the supplying roller 23 and the development blade 15 configured to regulate the layer thickness of the developer T formed on the surface of the elastic layer 13*a* in the development roller 13.

As illustrated in FIG. 4B, the development roller 13 is rotatably supported such that the metal core 13*j* is fit into a hole 44*h* in the drive side bearing 44 and a hole 45*h* in the non-drive side bearing 45. The supplying roller 23 is rotatably supported such that the metal core 23*j* is fit into a hole 44*i* in the drive side bearing 44 and a hole 45*i* in the non-drive side bearing 45. The agitator 21 is rotatably supported such that the agitating shaft member 20 is fit into a hole 44*k* in the drive side bearing 44 and a hole 45*k* in the non-drive side bearing 45.

The development roller gear 69 for transmitting a rotational driving force to the development roller 13 is rotatably disposed on the drive side end of the development roller 13 in the longitudinal direction F. The supply roller gear 70 for transmitting a rotational driving force to the supplying roller 23 is rotatably disposed on the drive side end of the supplying roller 23 in the longitudinal direction F. The agitation gear 71 for transmitting a rotational driving force to the agitator 21 is rotatably disposed on the drive side end of the agitating shaft member 20 in the longitudinal direction F. The development input gear 68 for transmitting a rotational driving force to each of the development roller gear 69, the supply roller gear 70, and the agitation gear 71 is disposed outside the drive side bearing 44 in the longitudinal direction F. The development cover member 32 is fixed outside the drive side bearing 44 in the longitudinal direction F so as to cover the development roller gear 69, the supply roller gear 70, the agitation gear 71, and the development input gear 68.

As illustrated in FIGS. 4A and 4B, the development cover member 32 includes a cylindrical portion 32*b* on the drive side in the longitudinal direction F. A drive transmitting portion 68*a* in the development input gear 68 is exposed through an opening 32*c* on the inner side of the cylindrical portion 32*b*. The drive transmitting portion 68*a* in the development input gear 68 engages with a main-body drive transmission member (not illustrated) when the process cartridge A is attached to the image forming apparatus B. The development input gear 68 is thus configured to receive a rotational drive force in the direction indicated by the arrow O transmitted from a drive motor (not illustrated) disposed on the image forming apparatus B. The rotational drive force input from the image forming apparatus B into the development input gear 68 is transmitted to the development roller 13 through the development roller gear 69, transmitted to the supplying roller 23 through the supply roller gear 70, and transmitted to the agitator 21 through the agitation gear 71. As a result, as illustrated in FIG. 2, the development roller 13 rotates in the direction indicated by the arrow D, the supplying roller 23 rotates in the direction indicated by the arrow C, and the agitator 21 rotates in the direction indicated by the arrow E.

[Circulation of Developer Inside Developing Device]

Figure 5A:
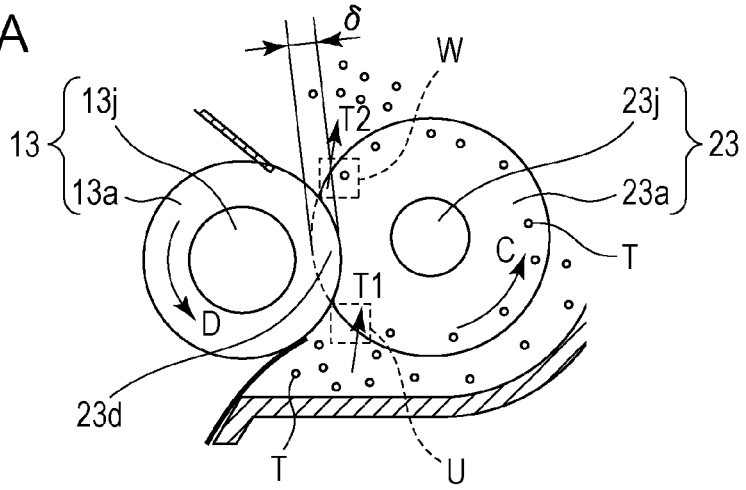
FIGS. 5A to 5C illustrate a developer supplying roller and its surroundings according to the first embodiment of the present invention.
Figure 5B:
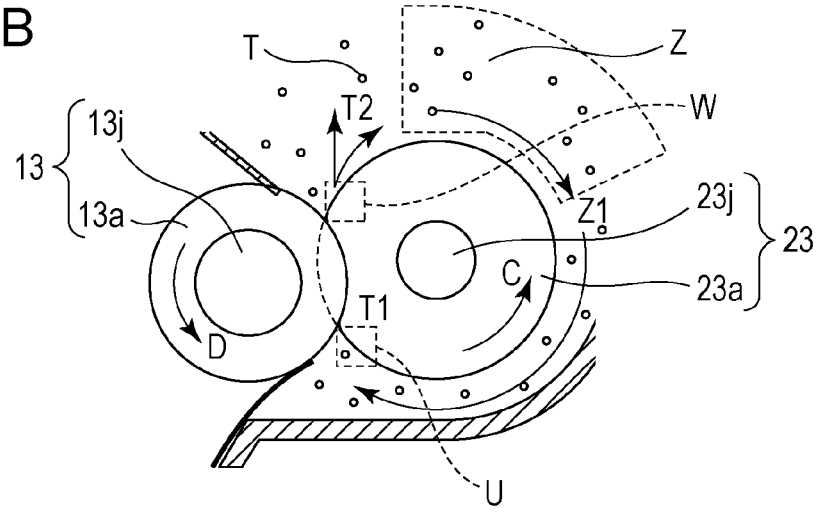
Figure 5C:
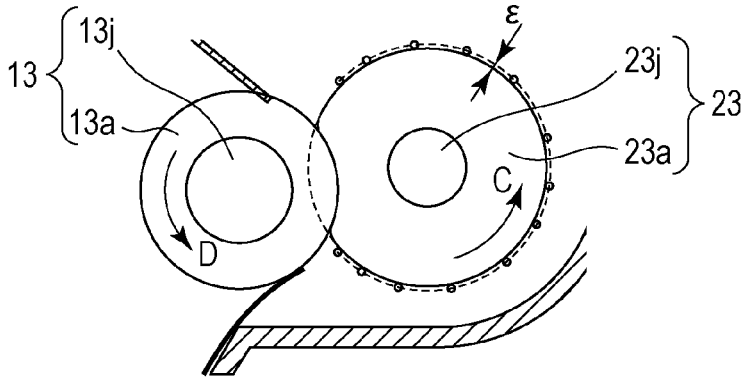

FIGS. 5A to 5C are enlarged schematic diagrams of the development roller 13, the supplying roller 23, and their surroundings during image forming operation. The supply of the developer to the development roller 13 by the supplying roller 23 is described with reference to FIG. 5A. As previously described, the development roller 13 rotates in the direction indicated by the arrow D, the supplying roller 23 rotates in the direction indicated by the arrow C, and thus they rotates in the same direction. The supplying roller 23 enters the development roller 13 with a certain inroad amount ($\delta$=1 mm in the present embodiment) and rotates in an elastically deformed state. At this time, the ratio of a peripheral speed of the supplying roller 23 to that of the development roller 13 is set at approximately 0.8.

When the supplying roller 23 which is covered with the developer T accommodated in the developer containing chamber 46 rotates in the direction indicated by the arrow C, a contact portion 23*d* of the elastic layer 23*a*, which is in contact with the development roller 13, is released from deformation. In a region U immediately after the elastic layer 23*a* is released, the elastic layer 23*a* elastically deformed (or compressively deformed) in contact with the development roller 13 is returned to its natural state. Because of the action in which cells in the elastic layer 23*a* are opened by the return to the natural state, air is drawn into the cells and the developer T is sucked in the direction indicated by the arrow T1. In a region W immediately before the supplying roller 23 comes into contact with the development roller 13 in the direction of rotation of the supplying roller 23 (direction indicated by the arrow C), because the elastic layer 23*a* in the natural state is elastically deformed (or compressively deformed), there is an action in which cells in the elastic layer 23*a* are closed. The region W is near the agitator side (the scattering prevention sheet side is opposite side) with respect to a line J5 connecting the center of the supplying roller 23 and the center of the developer carrying member. Thus the supplying roller 23 ejects the developer T retained in the cells in the elastic layer 23*a* in the direction indicated by the arrow T2 in the region W. That is, the supplying roller 23 has an action of supplying the developer T to the development roller 13 by sucking the developer T in the region U, rotating in a state where the developer T is retained in the cells in the elastic layer 23*a*, and ejecting the retained developer T in the region W. Accordingly, the most efficient way to cause the supplying roller 23 to retain the developer T in order to continuously supply the developer T to the development roller 13 is conveying the developer T to the region U.

Next, the circulation (flow) of the developer T in the vicinity of the supplying roller 23 is described with reference to FIGS. 5B and 5C.

As illustrated in FIG. 5B, in the region W, the developer is ejected in the direction indicated by the arrow T2 from the supplying roller 23. With this ejection, the developer T positioned in a region Z, which is spaced away from the elastic layer 23*a* by a certain distance above the supplying roller 23, is pushed by the developer T ejected from the supplying roller 23 and moved in the direction indicated by the arrow Z1. Here, in an image-forming period, the supplying roller 23 consistently rotates, a phenomenon in which the developer T is ejected from the supplying roller 23 in the region W continuously occurs, and thus the movement of the developer T in the direction indicated by the arrow Z1 continuously occurs. As a result, the developer T circulates in the direction indicated by the arrow Z1 in the vicinity of the supplying roller 23. This circulation of the developer T in the direction indicated by the arrow Z1 enables the developer T to be continuously supplied to the region U, where the supplying roller 23 continuously sucks the developer T. That is, the circulation of the developer T in the direction indicated by the arrow Z1 moves the developer T to the region U, which is the portion where the supplying roller 23 sucks the developer T. To achieve this movement, it is necessary for the developer T around the supplying roller 23 to maintain its flowability at more than a certain degree, and the developer T is required to have a density that is no higher than necessary.

As illustrated in FIG. 5C, in a thin layer region c of the surface of the supplying roller 23, the developer T is conveyed in the direction of rotation of the supplying roller 23 (direction of the arrow C) by the friction between the developer T and the supplying roller 23. As a result, in the thin layer region $\epsilon$ of the surface of the supplying roller 23, the developer T circulates in the direction of rotation of the supplying roller 23 (direction of the arrow C).

[Rotation and Action of Agitator]

Figure 6:
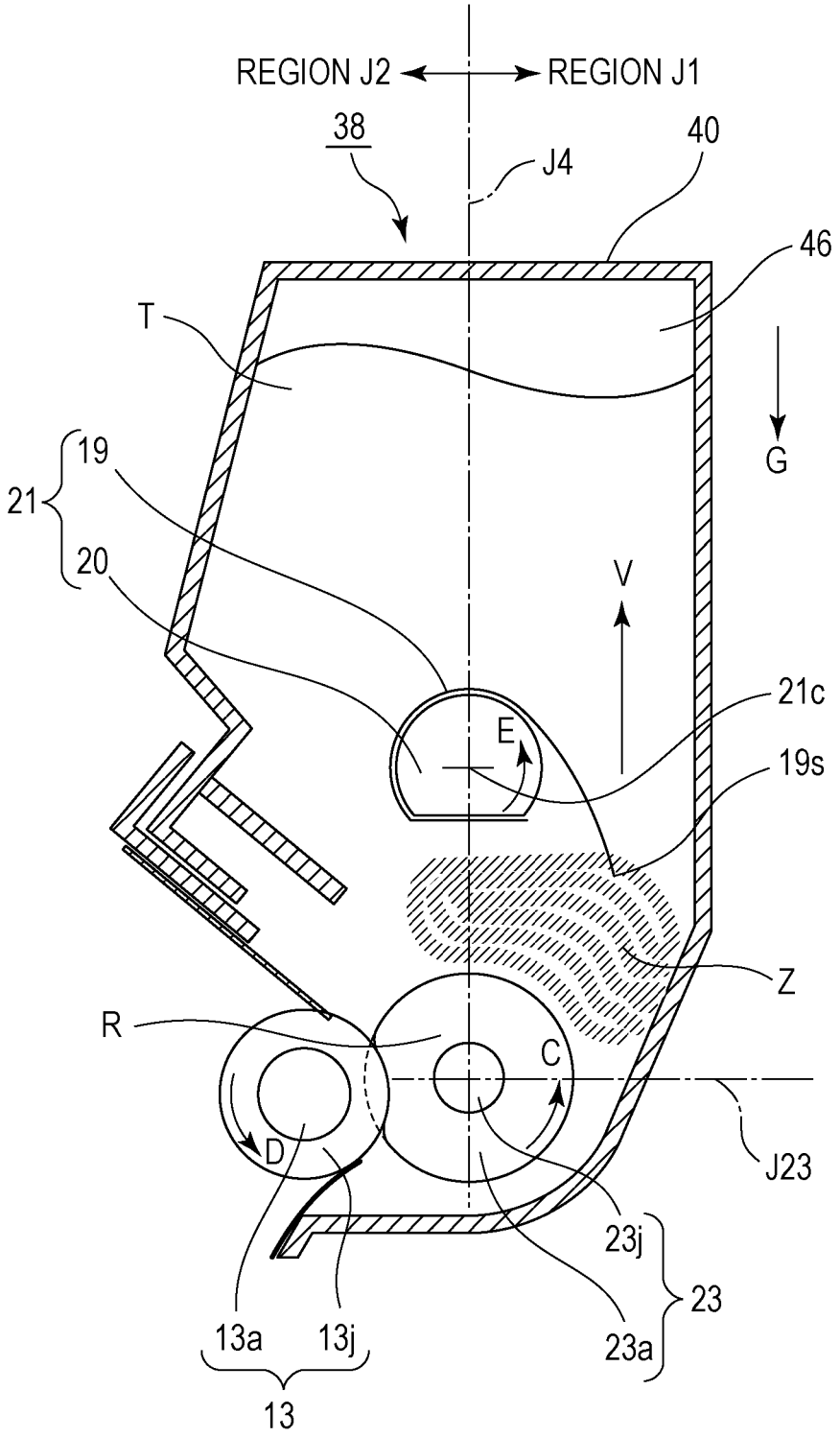
FIG. 6 is a sectional view of the developing device according to the first embodiment of the present invention.

FIG. 6 is a sectional view of the developing device 38. The developer containing chamber 46 and the agitator 21, which includes the agitating shaft member 20 and the sheet member 19, are disposed above the supplying roller 23 in the gravity direction G. The agitator 21 rotates in the same direction as the rotation direction of the supplying roller 23 (direction indicated by the arrow E). The ratio of the rotation speed of the agitator 21 to that of the supplying roller 23 is set at approximately 0.09. Here, "above the supplying roller 23 in the gravity direction G" indicates above a horizontal line J23 passing through the center of the supplying roller 23. Of the two regions partitioned by a line J4 passing through a rotational center 21*c* of the agitator 21 and extending along the gravity direction G, a region where the free end 19*s* of the sheet member 19 rotates in a direction opposing the gravity direction G is referred to as a region J1, and the other region is referred to as a region J2.

Here, the developer containing chamber 46 is disposed above the supplying roller 23 in the gravity direction G, and the direction in which the developer T is supplied to the supplying roller 23 is the gravity direction G. Thus, because of the action of a pressure caused by the weight of the developer T above the supplying roller 23 in the region Z in the gravity direction G, the developer T above the supplying roller 23 in the region Z tends to be high. FIG. 6 is a sectional view of the developing device 38 when the free end 19*s* of the sheet member 19 in the agitator 21 is in a region near the region Z (or within the region Z). At this time, the direction in which the sheet member 19 in the agitator 21 conveys the developer T is the direction opposing the gravity direction G (direction indicated by the arrow V). As a result, the agitator 21 conveys the developer T in a direction in which a pressure caused by the weight of the developer T is reduced, and this can prevent the density of the developer T in the region Z from increasing more than necessary. Accordingly, satisfactory circulation of the developer T in the vicinity of the supplying roller 23 (region Z) can be maintained.

Figure 7:
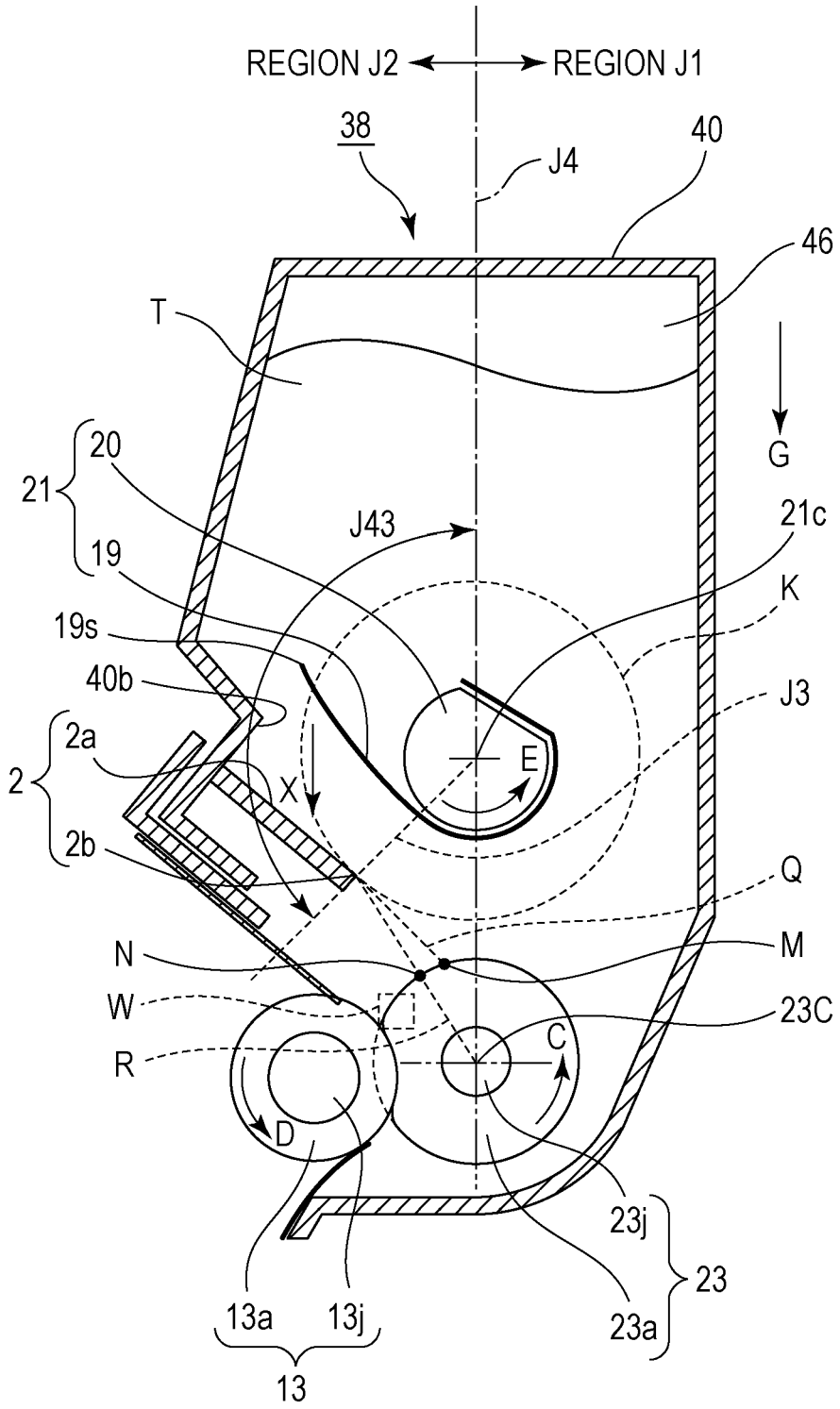
FIG. 7 is a sectional view of the developing device according to the first embodiment of the present invention.

Next, an operation and action of the agitator 21 in the region J2 are described. FIG. 7 is a sectional view of the developing device 38 in a state where the agitator 21 rotates by a certain degree from the state illustrated in FIG. 6. As illustrated in FIG. 7, an inner wall 40*b* of the development frame 40 in the region J2 is provided with a sheet member regulator 2 (hereinafter referred to as regulator) with which the free end 19*s* in the sheet member 19 comes into contact during rotation of the agitator 21. The regulator 2 includes a regulating surface 2*a* continuously extending in the longitudinal direction and elastically deforming the sheet member 19 by contact with the sheet member 19. The regulating surface 2*a* includes a release point 2*b* where elastic deformation of the sheet member 19 is released to the downstream side in the direction of rotation of the agitator 21 (direction indicated by the arrow E). In the present embodiment, the regulator 2 is integral with the development frame 40. However, the regulator 2 may be a component that is different from the development frame 40 and that is joined thereto by, for example, bonding. In the present embodiment, the regulating surface 2*a* does not have a cut or an opening as seen from a direction orthogonal to the regulating surface 2*a*. However, the regulating surface 2*a* may have an opening or a cut in its part. Here, the line connecting the release point 2*b* and the center of the supplying roller 23 is referred to as a line R. The tangent to a circle K whose center is the rotational center 21*c* of the agitator 21 at the release point 2*b* is referred to as a line Q. The line connecting the rotational center 21*c* of the agitator 21 and the release point 2*b* is referred to as a line J3. At this time, an intersection point M of the line Q and the surface of the elastic layer 23*a* in the supplying roller 23 is located upstream of an intersection point N of the line R and the elastic layer 23*a* in the supplying roller 23 in the direction of rotation of the supplying roller 23 (direction indicated by the arrow C).

As illustrated in FIG. 7, in the direction of rotation of the agitator 21 (direction indicated by the arrow E), the free end 19*s* of the sheet member 19 in the agitator 21 is in a range from the line J4 to the line J3 in the region J2 (range J43 in FIG. 7). In this case, movement of the developer T toward the direction indicated by the arrow X caused by rotation of the agitator 21 in the direction indicated by the arrow E is mainly received by the regulating surface 2*a* of the regulator 2. Accordingly, in the direction of rotation of the agitator 21 (direction indicated by the arrow E), when the free end 19*s* of the sheet member 19 in the agitator 21 is in a region J43 in FIG. 7, a conveying force by the agitator 21 does not directly act on the region W (see FIGS. 5A and 5B), where the developer T is ejected from the supplying roller 23. Accordingly, the density of the developer T in the region W, where the developer T is ejected from the supplying roller 23, does not increase more than necessary, and thus the circulation of the developer T caused by the ejection of the developer T from the supplying roller 23 is not impaired.

Figure 1:
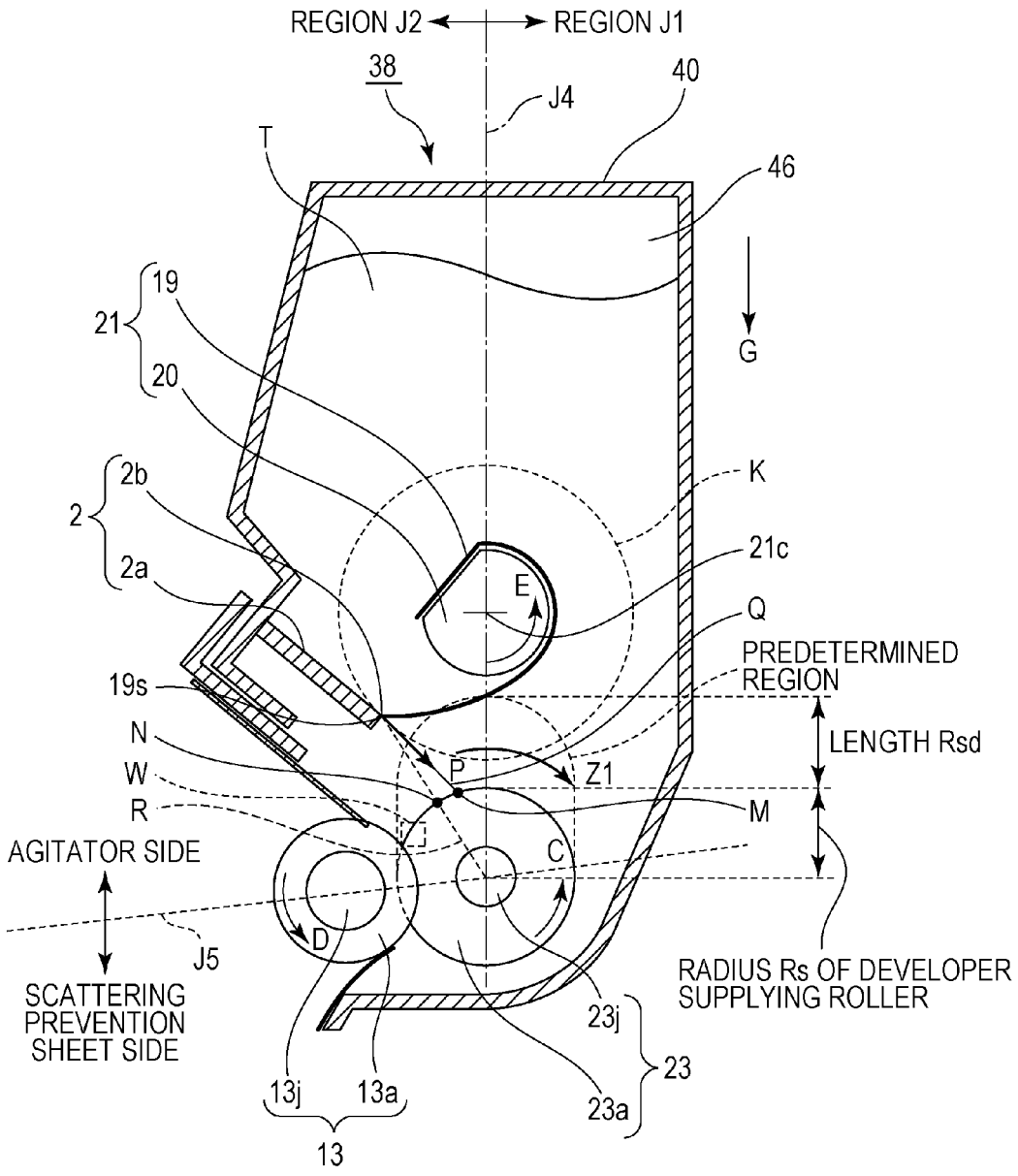
FIG. 1 is a sectional view of a developing device according to a first embodiment of the present invention.

Next, an action of the agitator 21 occurring when the sheet member 19 in the agitator 21 is released from the release point 2*b* is described with reference to FIG. 1. FIG. 1 is a sectional view of the developing device 38 when the agitator 21 rotates by a certain degree from the state illustrated in FIG. 7. The direction of conveying the developer T by the agitator 21 when the free end 19*s* of the sheet member 19 in the agitator 21 is released is the direction indicated by the arrow P on the line Q (direction of the tangent of the circle K at the release point 2*b*). As previously described, the intersection point M of the line Q and the surface of the elastic layer 23*a* in the supplying roller 23 is located upstream of the intersection point N of the line R and the elastic layer 23*a* in the supplying roller 23 in the direction of rotation of the supplying roller 23 (direction indicated by the arrow C). Thus the developer T conveyed by the release of the sheet member 19 in the agitator 21 from the release point 2*b* moves in substantially the same direction as the circulation of the developer T in the direction indicated by the arrow Z1 caused by the ejection of the developer T from the supplying roller 23, as previously described. This can facilitate the circulation of the developer T in the direction indicated by the arrow Z1 caused by the ejection by the supplying roller 23.

Figure 9:
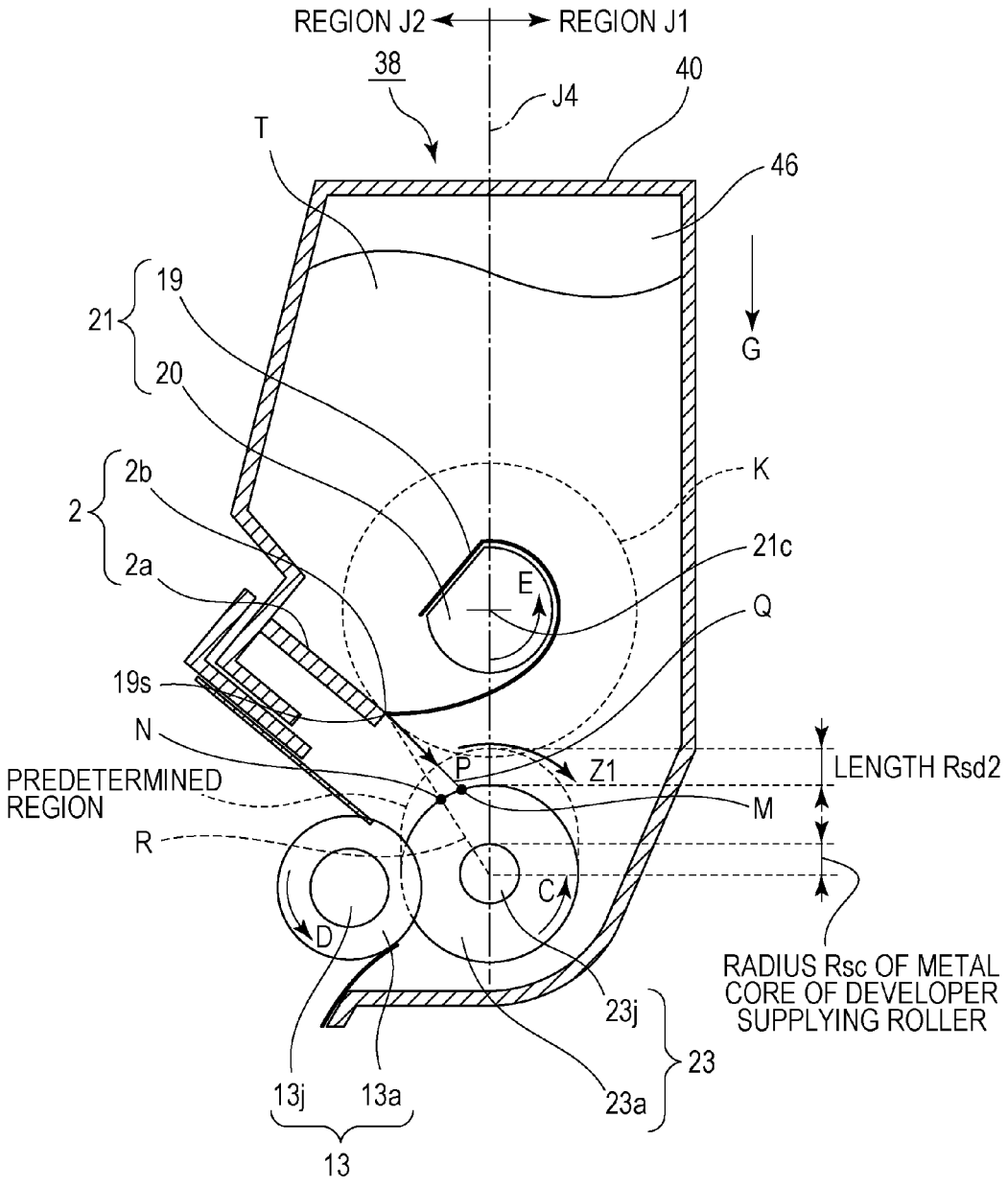
FIG. 9 is a sectional view of the developing device according to the first embodiment of the present invention.

The region agitated by the agitator can be at least part of the region illustrated in FIG. 1. The region agitated is in the vicinity of the supplying roller 23, and this can reduce an increase in the density of the developer T more than necessary. Here, the region in the vicinity of the supplying roller 23 is defined as described below. First, the length (height) in the gravity direction is a length Rsd that is the length from the surface of the supplying roller 23 to an upper location corresponding to the length of a radius Rs of the supplying roller. The length (width) in the horizontal direction is a diameter of a section of the supplying roller. Agitating at least part of this predetermined region can prevent the density of the developer T in the region Z from increasing more than necessary. As illustrated in FIG. 9, the predetermined region may be a region nearer the supplying roller, and at least part of that region may be agitated. In that case, the length in the gravity direction of the predetermined region may be a length Rsd2 that is a length from the surface of the supplying roller to an upper portion corresponding to the length of a radius Rsc of the metal core of the supplying roller.

The agitation is performed by the agitator passing through the predetermined region. In particular, the agitation caused by the passage of the free end of the sheet member being a flexible member efficiently conveys the developer T.

As described above, the configuration in which the direction of rotation of the supplying roller 23 (direction indicated by the arrow C) and the direction of rotation of the agitator 21 (direction indicated by the arrow E) are the same can prevent the density of the developer T in the region Z from increasing more than necessary. Furthermore, in the region J2, the provision of the regulator 2 can prevent the density of the developer T in the region W from increasing more than necessary and can also facilitate the circulation of the developer T in the direction indicated by the arrow Z1 caused by the ejection of the developer T from the supplying roller 23. That is, because satisfactory circulation around the supplying roller 23 can be maintained and the developer T can be consistently sent to the region U, where the supplying roller 23 sucks the developer T, the developer T can be stably supplied to the development roller 13. As a result, a layer of the developer T with a stable thickness can be formed on the surface of the elastic layer 13*a* in the development roller 13, and thus the developing device 38 capable of developing a high-quality image can be provided.

[Action of Contact Between Agitator and Supplying Roller]

Figure 8:
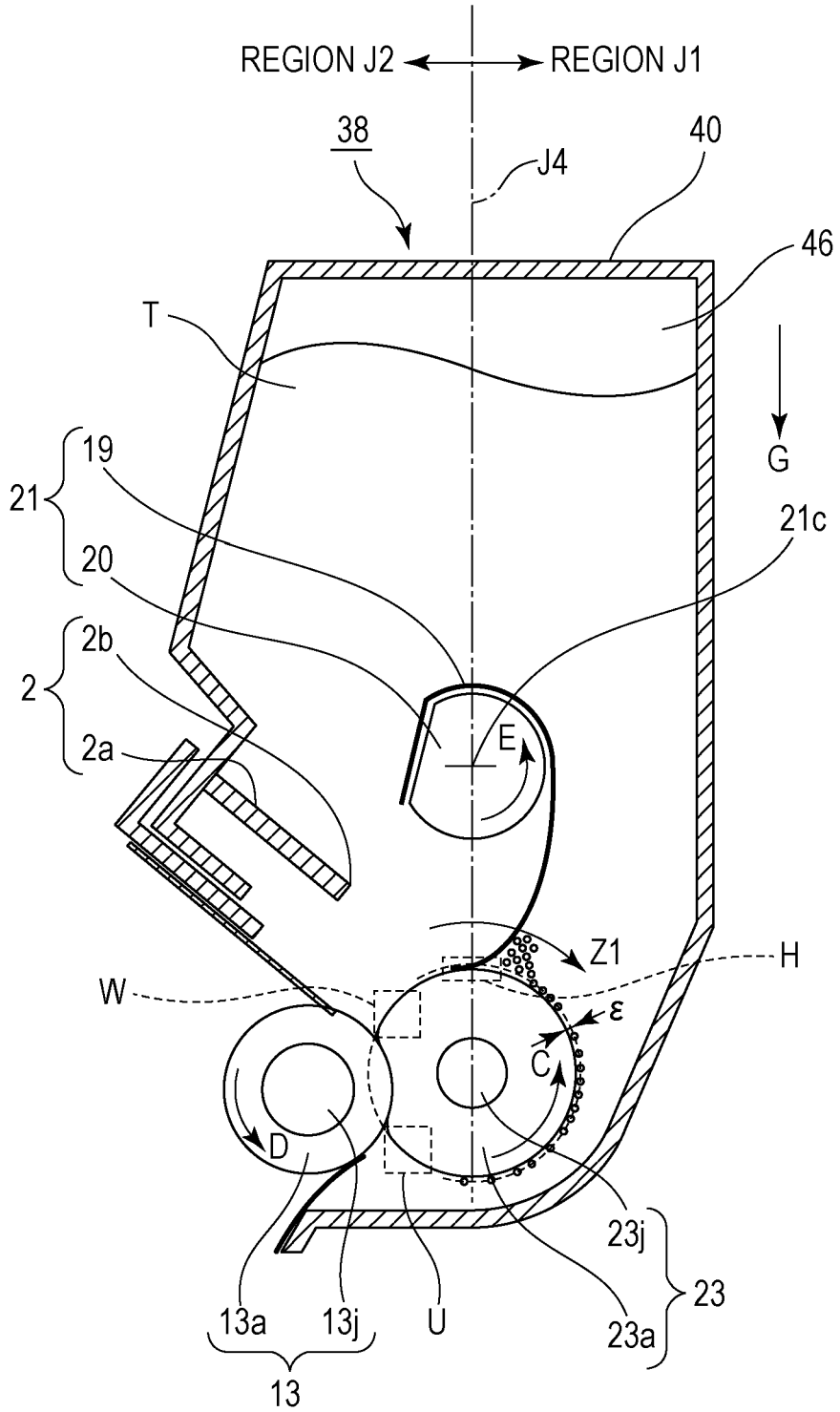
FIG. 8 is a sectional view of the developing device according to the first embodiment of the present invention.

Next, an action of contact between the agitator 21 and the supplying roller 23 is described. FIG. 8 illustrates a state where the agitator 21 is in contact with the supplying roller 23. As illustrated in FIG. 8, after the sheet member 19 in the agitator 21 is released from the release point 2*b*, the agitator 21 rotates from the state illustrated in FIG. 7 in the direction indicated by the arrow E and comes into contact with the supplying roller 23 in a contact region H. The contact of the sheet member 19 with the supplying roller 23 can block the circulation of the developer T in the direction of rotation of the supplying roller 23 (direction indicated by the arrow C) in a thin-layer region ϵ of the surface of the supplying roller 23. That is, excessive conveyance of the developer T to the region W, where the developer T is ejected from the supplying roller 23, can be avoided, thus the density of the developer T in the region W can be prevented from increasing more than necessary, and the circulation of the developer T caused by the ejection of the developer T from the supplying roller 23 is not impaired.

In addition, because the agitator 21 rotates in the rotation direction (direction indicated by the arrow E), the blocked developer T is conveyed in the same direction as the circulation (in the direction indicated by the arrow Z1) formed by the ejection of the developer T from the supplying roller 23 in the region W. As a result, when the sheet member 19 is in contact with the supplying roller 23, the developer T can be sent to the region U more efficiently.

Here, a case where the supplying roller 23 makes less than one rotation while the sheet member 19 in the agitator 21 is in contact with the supplying roller 23 is described. In this case, there is a region where, in one cycle of the supplying roller 23, the developer T in the thin-layer region ϵ of the surface of the supplying roller 23 is not stripped off by the sheet member 19. The developer T remaining in the thin-layer region ϵ is charged by friction in the contact portion with the development roller 13, and it sticks to the surface of the supplying roller 23 more firmly. With repetition of this process, the attachment of the developer T is uneven within one cycle of the supplying roller 23. The developer T firmly sticking to the surface of the supplying roller 23 may cover cells of the supplying roller 23, the ejection of the developer T from the inside of the supplying roller 23 in the region W may be inhibited, and furthermore, the suction of the developer T in the region U may be inhibited. As a result, image density irregularities may occur. Thus the supplying roller 23 can make one or more rotations while in contact.

In accordance with the ratio between a peripheral speed of the agitator 21 and that of the supplying roller 23, as described above, the supplying roller 23 makes approximately two rotations while the sheet member 19 in the agitator 21 is in contact with the supplying roller 23, in the present embodiment. With one or more rotations of the supplying roller in the state where the sheet member 19 is in contact with the supplying roller 23, there is no unevenness of the attached developer T within one cycle of the supplying roller 23.

In the present embodiment, approximately two rotations are made by the supplying roller while the sheet member 19 in the agitator 21 is in contact with the supplying roller 23. The supplying roller may make at least one or more rotations. As previously described, the rotation of the sheet member 19 in the agitator 21 in contact with the supplying roller 23 can prevent the developer T from being excessively conveyed to the region W. Thus the developer T can be sent to the region U, where the developer T is smoothly sucked. At least one or more rotations of the supplying roller 23 while the sheet member 19 in the agitator 21 is in contact with the supplying roller 23 can uniformize the developer T in the thin-layer region ϵ of the surface of the supplying roller 23 in the peripheral direction of the supplying roller 23. This can further reduce the image-density irregularities.

Here, the sheet member 19 in the agitator 21 may come into contact with the supplying roller 23 depending on the amount of the developer T. When the developer T is consumed and its amount becomes small, the weight of the developer T is small in the region J1, and the developer T may not be conveyed to the region U. With the contact between the sheet member 19 and the supplying roller 23, the developer T on the surface of the supplying roller 23 can be sent to the region U by the above-described action. As a result, even when the amount of the developer T becomes small, the developer T can be contained in the supplying roller 23. To achieve such a design, the thickness, material, or other factors of the sheet member 19 may be adjusted to an appropriate condition. That is, the configuration may be designed such that when the developer T is full to the vicinity of the agitating shaft member 20, the sheet member 19 winds around the agitating shaft member 20 by the pressure of the surrounding developer T. The configuration may also be designed such that when the developer T is consumed and its pressure is reduced, the sheet member comes into contact with the supplying roller 23. The configuration is not limited to the above-described examples. The configuration in which the sheet member comes into contact with the supplying roller from the beginning.

Second Embodiment

Next, a second embodiment is described with reference to FIG. 10. In the present embodiment, the same portions as in the first embodiment are not described. The members having the same functions as in the above-described first embodiment have the same reference numerals.

Figure 10:
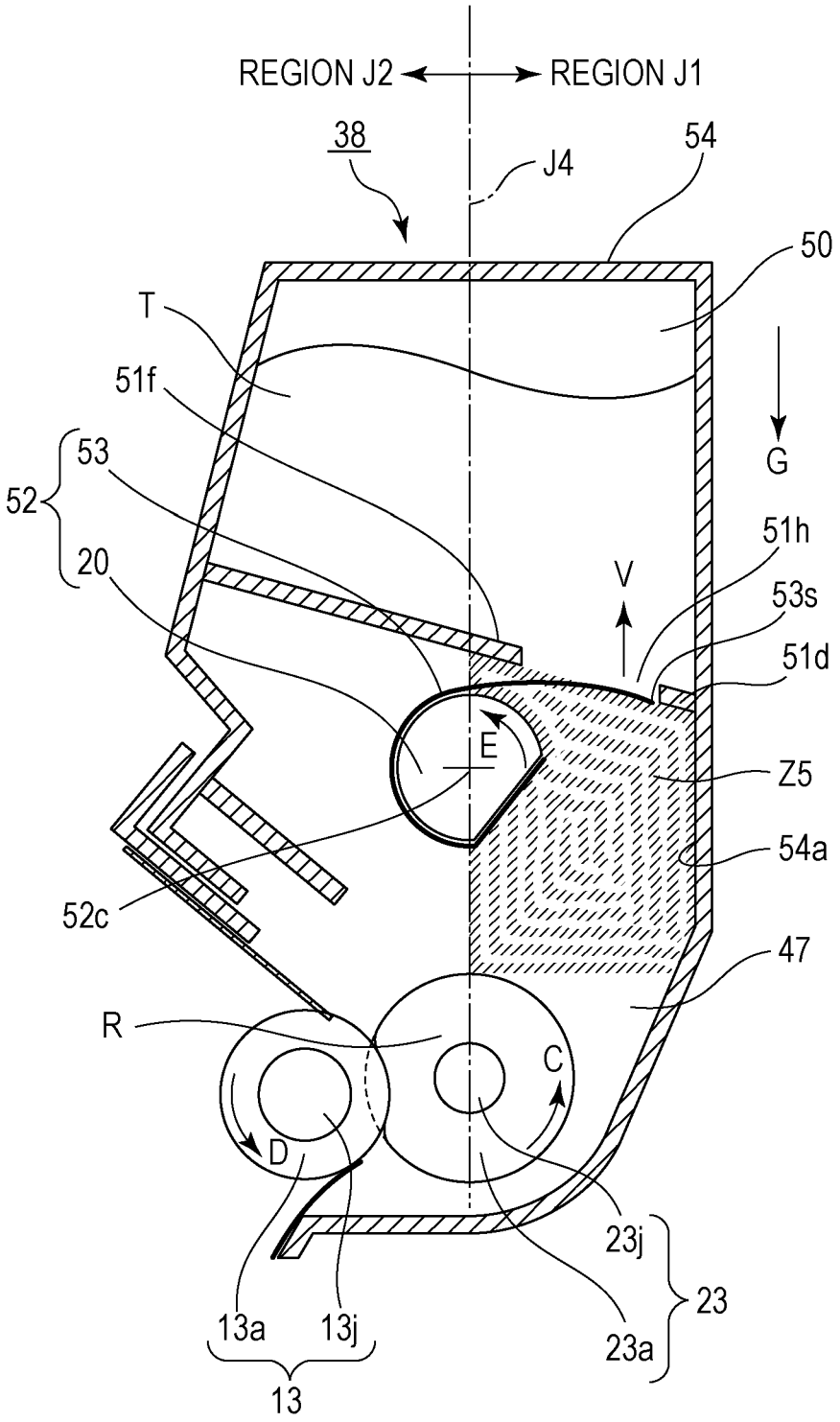
FIG. 10 is a sectional view of the developing device according to a second embodiment of the present invention.

As illustrated in FIG. 10, in the present embodiment, a developing chamber 47 accommodating the supplying roller 23, the development roller 13, and an agitator 52 and a developer containing chamber 50 are divided by partitions 51*f* and 51*d*. In the present embodiment, the developer containing chamber 50 is located above the agitator 52 in the gravity direction G.

The developer T in the developing chamber 47 mutually slides and contacts with the neighboring developer T, an inner wall 54*a* of a development frame 54, and the agitator 52 by its circulation caused by the supplying roller 23 and the agitator 52. Thus the charge amount on the surface of the developer T tends to increase, and the developer T tends to degrade. However, because the mutual sliding of the developer T in the developer containing chamber 50 is smaller than that of the developer T in the developing chamber 47, the charge on the surface of the developer T does not easily rise, and the developer T does not easily degrade. Accordingly, to consistently make the state of all of the developer T inside the developing device 38 (e.g., charge amount, degree of degradation) uniform, the developer T in the developing chamber 47 and the developer T in the developer containing chamber 50 can circulate such that they are consistently interchanged with each other.

In the present embodiment, the inner space defined by the development frame 54 is divided by the partitions 51*d* and 51*f*, which are integral with the development frame 54, into the developing chamber 47 and the developer containing chamber 50. However, a configuration in which the developing chamber 47 and the developer containing chamber 50 are defined by different frames and they are connected by, for example, welding may also be used. Another configuration in which a flexible developer container is disposed inside the development frame 54 may also be used. For example, the configuration in which a flexible container is employed as the developer container illustrated in Japanese Patent Laid-Open No. 2013-037345 may also be used.

A supply opening 51*h* as an opening that allows the developer T to be supplied from the developer containing chamber 50 to the developing chamber 47 is disposed within an area in the region J1. That is, the developer is supplied through the supply opening 51*h* from the developer containing chamber 50 to the developing chamber 47 in the direction indicated by the arrow G. To more efficiently draw the developer T falling under its own weight to the supplying roller, a portion of the supplying roller that is furthermost from the developer carrying member can be located within an area in the region J1. This enables the developer T to be efficiently supplied to a lower portion of the supplying roller. A portion of the supplying roller that can catch the developer T well is a portion that is released from contact with the developer carrying member, and its upper portion is covered with the developer carrying member. Thus the number of paths for use in supplying the developer T to the catching portion of the supplying roller is small. Therefore, a configuration in which the developer T can be actively supplied to a possible supply path can be used.

In a process where a sheet member 53 in the agitator 52 rotates in the direction indicated by the arrow E, its free end 53*s* enters the supply opening 51*h*. That is, in a region Z5 that is in the region J1 in the developing chamber 47 and that is located above the elastic layer 23*a* in the supplying roller 23 in the horizontal direction, the sheet member 53 in the agitator 52 conveys the developer T in a direction indicated by the arrow V opposing the direction indicated by the arrow G in which the developer T is supplied from the developer containing chamber 50. The developer T conveyed by the sheet member 53 in the agitator 52 is sent to the developer containing chamber 50 when the free end 53*s* of the sheet member 53 enters the supply opening 51*h* of the developer containing chamber 50. At that time, the developer T in the developer containing chamber 50 and the developer T conveyed from the developing chamber 47 to the developer containing chamber 50 by the agitator 52 are mixed with each other, and the mixed developer T is supplied to the developing chamber 47 again by its own weight. Accordingly, because the developer T circulates throughout the developing chamber 47 and the developer containing chamber 50, the state of all the developer T inside the developing device 38 can be consistently maintained uniform. As a result, the developer T in the uniform state (e.g., charge amount, degree of degradation) is supplied to the development roller 13 by the supplying roller 23, and thus the developing device 38 capable of developing a high-quality image can be provided.

The other configurations are substantially the same as in the first embodiment, and substantially the same advantages as in the first embodiment are obtainable.

As described above, according to the present invention, satisfactory circulation of the developer in the vicinity of the developer supplying roller can be maintained, the developer can be stably supplied to the developer carrying member, and high-quality images can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-255203 filed Dec. 10, 2013, which is hereby incorporated by reference herein in its entirety.

What is claimed is:

1. A developing device comprising:

a developer carrying member configured to carry developer;

a developer supplying roller rotatably supported, being in contact with the developer carrying member, and including a continuous foam elastic layer configured to supply the developer to the developer carrying member; and an agitator rotatable in the same direction as the developer supplying roller and configured to agitate and pass through at least part of a predetermined region above the developer supplying roller in a gravity direction, wherein a length of the predetermined region in the gravity direction is a length from an upper portion of the developer supplying roller to a location corresponding to a radius of the developer supplying roller, and wherein a region W where the elastic layer is elastically deformed from its natural state by coming into contact with the developer carrying member is near a side of the agitator with respect to a line connecting a center of the developer supplying roller and a center of the developer carrying member, and wherein the agitator conveys the developer to a region U where the elastic layer is elastically deformed into its natural state and the developer supplying roller sucks the developer.

2. A developing device comprising:

a developer carrying member configured to carry developer;

a developer supplying roller rotatably supported, being in contact with the developer carrying member, and including a continuous foam elastic layer configured to supply the developer to the developer carrying member; and an agitator including a flexible member for agitating the developer, rotatable in the same direction as the developer supplying roller, and disposed above the developer supplying roller in a gravity direction, wherein a region where the elastic layer is elastically deformed from its natural state by coming into contact with the developer carrying member is near a side of the agitator with respect to a line connecting a center of the developer supplying roller and a center of the developer carrying member, wherein the flexible member is arranged so as to be caused to come into contact with the developer supplying roller by rotation of the agitator, and wherein the agitator conveys the developer to a region U where the elastic layer is elastically deformed into its natural state and the developer supplying roller sucks the developer.

3. The developing device according to claim 1, wherein the agitator includes an agitating shaft member rotatably supported and a flexible member having an end connected to the agitating shaft member.

4. The developing device according to claim 3, further comprising a development frame for accommodating the developer, wherein the development frame includes a regulator configured to regulate movement of the developer conveyed by the flexible member, the regulator is disposed in a region where the flexible member rotates in the gravity direction, and the region is one of two regions divided by a line passing through a rotational center of the agitator and extending along the gravity direction.

5. The developing device according to claim 4, wherein an intersection point between a tangent to a circle whose center is the rotational center of the agitator at a release point where the flexible member is released from the regulator and a surface of the developer supplying roller is located upstream of an intersection point of a line connecting the release point and the center of the developer supplying roller and the surface of the developer supplying roller in the direction of rotation of the developer supplying roller.

6. The developing device according to claim 3, further comprising a developer containing chamber disposed above the agitator in the gravity direction, wherein the developer containing chamber has an opening that allows the developer to be supplied to the developer supplying roller, the opening is in a region where the flexible member rotates in a direction opposing the gravity direction, and the region is one of two regions divided by a line passing through a rotational center of the agitator and extending along the gravity direction.

7. The developing device according to claim 6, wherein the flexible member in the agitator enters the opening during rotation.

8. The developing device according to claim 3, wherein a distance from a center of the agitating shaft member to an end surface of a free end of the flexible member is longer than a distance from the center of the agitating shaft member to the surface of the developer supplying roller.

9. The developing device according to claim 3, wherein the developer supplying roller includes a portion furthermost from the developer carrying member, and the portion is located in a region where the flexible member rotates in a direction opposing the gravity direction, and the region is one of two regions divided by a line passing through a rotational center of the agitator and extending along the gravity direction.

10. The developing device according to claim 1, wherein a length of the predetermined region in the gravity direction is a length from an upper portion of the developer supplying roller to a location corresponding to a radius of a metal core of the developer supplying roller.

11. The developing device according to claim 1, wherein passage of the agitator through the predetermined region agitates the developer.

12. The developing device according to claim 1, wherein the developer carrying member and the developer supplying roller rotate in the same direction.

13. The developing device according to claim 2, wherein in a state where the developer supplying roller and the flexible member are in contact with each other, the developer supplying roller makes at least one or more rotations.

14. A process cartridge comprising:

the developing device according to claim 1; and an image bearing member configured to bear a developer image.

15. An image forming apparatus for forming an image on a sheet, the image forming apparatus comprising:

the developing device according to claim 1.

16. The developing device according to claim 2, wherein the agitator includes an agitating shaft member rotatably supported and a flexible member having an end connected to the agitating shaft member.

17. The developing device according to claim 16, further comprising a development frame for accommodating the developer, wherein the development frame includes a regulator configured to regulate movement of the developer conveyed by the flexible member, the regulator is disposed in a region where the flexible member rotates in the gravity direction, and the region is one of two regions divided by a line passing through a rotational center of the agitator and extending along the gravity direction.

18. The developing device according to claim 17, wherein an intersection point between a tangent to a circle whose center is the rotational center of the agitator at a release point where the flexible member is released from the regulator and a surface of the developer supplying roller is located upstream of an intersection point of a line connecting the release point and the center of the developer supplying roller and the surface of the developer supplying roller in the direction of rotation of the developer supplying roller.

19. The developing device according to claim 16, further comprising a developer containing chamber disposed above the agitator in the gravity direction, wherein the developer containing chamber has an opening that allows the developer to be supplied to the developer supplying roller, the opening is in a region where the flexible member rotates in a direction opposing the gravity direction, and the region is one of two regions divided by a line passing through a rotational center of the agitator and extending along the gravity direction.

20. The developing device according to claim 19, wherein the flexible member in the agitator enters the opening during rotation.

21. A developing device comprising:

a developer carrying member configured to carry developer;

a developer supplying roller rotatably supported, being in contact with the developer carrying member, and including a continuous foam elastic layer configured to supply the developer to the developer carrying member; and an agitator rotatable in the same direction as the developer supplying roller and configured to agitate at least part of a predetermined region above the developer supplying roller in a gravity direction, wherein a length of the predetermined region in the gravity direction is a length from an upper portion of the developer supplying roller to a location corresponding to a radius of the developer supplying roller, wherein a region W where the elastic layer is elastically deformed from its natural state by coming into contact with the developer carrying member is near a side of the agitator with respect to a line connecting a center of the developer supplying roller and a center of the developer carrying member, and wherein a rotational center of the agitator is located below an opening of a developer containing chamber.

22. A developing device comprising:

a developer carrying member configured to carry developer;

a developer supplying roller rotatably supported, being in contact with the developer carrying member, and including a continuous foam elastic layer configured to supply the developer to the developer carrying member; and an agitator including a flexible member for agitating the developer, rotatable in the same direction as the developer supplying roller, and disposed above the developer supplying roller in a gravity direction, wherein a region where the elastic layer is elastically deformed from its natural state by coming into contact with the developer carrying member is near a side of the agitator with respect to a line connecting a center of the developer supplying roller and a center of the developer carrying member, and wherein the flexible member is arranged so as to be caused to come into contact with the developer supplying roller by rotation of the agitator, wherein a rotational center of the agitator is located below an opening of a developer containing chamber.

* * * * *